US007210903B2

(12) United States Patent
Lyons

(10) Patent No.: US 7,210,903 B2
(45) Date of Patent: May 1, 2007

(54) LOBED JOINT DRAFT INDUCER BLOWER

(75) Inventor: Leslie A Lyons, Cassville, MO (US)

(73) Assignee: Fasco Industries, Inc., Eaton Rapids, MI (US)

( * ) Notice: Subject to any disclaimer, the term of this patent is extended or adjusted under 35 U.S.C. 154(b) by 300 days.

(21) Appl. No.: 10/934,070

(22) Filed: Sep. 3, 2004

(65) Prior Publication Data

US 2006/0051206 A1 Mar. 9, 2006

(51) Int. Cl.
*F04D 29/44* (2006.01)

(52) U.S. Cl. ..... 415/204; 415/206; 415/211.1; 415/212.1; 415/213.1; 415/214.1

(58) Field of Classification Search ..... 415/119, 415/203, 204, 206, 211.1, 212.1, 213.1, 214.1
See application file for complete search history.

(56) References Cited

U.S. PATENT DOCUMENTS

| | | | | |
|---|---|---|---|---|
| 1,484,055 | A * | 2/1924 | Beugler | 415/206 |
| 1,650,873 | A * | 11/1927 | Kay | 415/206 |
| 2,411,816 | A * | 11/1946 | Teague, Jr. | 415/204 |
| 2,540,178 | A * | 2/1951 | Smith | 415/206 |
| 3,145,912 | A * | 8/1964 | Weis | 415/204 |
| 3,300,122 | A * | 1/1967 | Bowles et al. | 415/206 |
| 3,856,431 | A | 12/1974 | Tucker | |
| 4,599,042 | A | 7/1986 | Colliver | |
| 5,257,904 | A | 11/1993 | Sullivan | |
| 5,316,439 | A | 5/1994 | Gatley, Jr. et al. | |
| 5,443,364 | A | 8/1995 | Mistry et al. | |
| 5,484,259 | A | 1/1996 | Ahmed et al. | |
| 5,536,140 | A * | 7/1996 | Wagner et al. | 415/119 |
| 5,620,302 | A | 4/1997 | Garrison et al. | |
| 5,954,476 | A | 9/1999 | Stewart et al. | |
| D439,648 | S | 3/2001 | Jones et al. | |
| 6,206,633 | B1 * | 3/2001 | Nakamura et al. | 415/206 |
| 6,314,894 | B1 | 11/2001 | Gatley, Jr. | |
| 6,386,123 | B1 | 5/2002 | Gatley, Jr. | |
| 6,468,034 | B1 * | 10/2002 | Garrison et al. | 415/212.1 |
| 6,494,152 | B2 | 12/2002 | Gatley, Jr. | |
| 6,511,288 | B1 | 1/2003 | Gatley, Jr. | |
| 6,553,923 | B2 | 4/2003 | Gatley, Jr. | |
| 6,595,146 | B2 | 7/2003 | Gatley, Jr. | |
| 6,604,906 | B2 | 8/2003 | Ozeki et al. | |
| 2002/0138941 | A1 * | 10/2002 | Paterson et al. | 15/412 |

FOREIGN PATENT DOCUMENTS

| | | |
|---|---|---|
| JP | 54021608 A | 2/1979 |

* cited by examiner

*Primary Examiner*—Christopher Verdier
(74) *Attorney, Agent, or Firm*—Baker & Daniels LLP

(57) ABSTRACT

A draft inducer blower for high efficiency furnaces, including a blower housing which facilitates maximum air flow efficiency through the blower housing while reducing air flow noises. The blower housing generally includes a housing body and housing cover which define an exhaust transition therebetween, which transitions the air flow from the circular main cavity of the blower housing to the blower housing outlet. The housing body and housing cover are attached to one another via a lobed joint along the exhaust transition, and each include complementary, smoothly contoured inner surfaces to facilitate smooth air flow through the exhaust transition toward the outlet. Additionally, the housing body and housing cover include cooperating cutoff surfaces which form a broadly radiused cutoff within the blower housing to reduce or eliminate the blade pass noise associated with contact of the air flow from the impeller with the cutoff.

25 Claims, 13 Drawing Sheets

LOBED JOINT DRAFT INDUCER BLOWER

BACKGROUND OF THE INVENTION

1. Field of the Invention

The present invention relates to air moving devices, and in particular, to blowers of the type which are used with high efficiency (e.g., 90% or higher efficiency) furnaces for drawing air from outside of a building into the furnace to support combustion and to expel combustion exhaust products outside of the building. More particularly, the present invention relates to a blower which provides more efficient air flow through the blower housing with decreased blower noise.

2. Description of the Related Art

In high efficiency furnaces, standard chimney air-draw effects are not sufficient to assure the required air flow through the furnace heat exchangers, and therefore, high efficiency furnaces utilize draft inducer blowers to provide sufficient air flow through the furnace. In particular, the blowers of high efficiency furnaces pull flue gases through the furnace heat exchangers and then push the flue gases out through exhaust piping to the exterior of the building. The length of the flue piping is limited by the static pressure induced on the flue gases by the draft inducer blower, and higher static pressures typically allow longer runs of flue piping. One measure of the efficiency of the draft inducer blower is the static pressure generated by the blower on the flue gases at a given air flow rate, wherein a blower is more efficient if it can generate higher pressures and air flows for a given power input to the electric motor which drives the blower impeller.

One known blower for a high efficiency furnace is shown in FIGS. 1–4, and generally includes a blower housing 20 having a housing body 22 and a housing cover 24. Housing body 22 is typically formed as a molded plastic component, having a cylindrical outer wall 26, a planar, annular top wall 28, and an axially recessed, planar, circular wall 30 to which electric motor 32 is mounted. Housing body 22 further includes an integral, tubular exhaust transition 34 projecting tangentially therefrom, having a circular outlet 36 to which an exhaust pipe (not shown) is connected. Housing cover 24 is a substantially flat, molded plastic circular plate which is attached to housing body 22 by being captured between housing body 22 and wall 38 of a furnace, as shown in FIG. 4. Specifically, a plurality of bolts 40 are inserted through respective mounting lugs 42 in housing body 22 and into a set of corresponding holes 44 in furnace wall 38 to thereby attach the blower housing 20 to the furnace. Holes 44 in furnace wall 38 are disposed in a standard pattern with a predetermined, fixed diameter, typically about 9.25 inches. An impeller 46, shown in FIGS. 2–4, is disposed within the interior of blower housing 20 between housing body 22 and housing cover 24, and is mounted for rotation upon drive shaft 48 (FIG. 4) of motor 32.

In operation, rotation of impeller 46 by motor 32 draws exhaust gases through a centrally disposed circular inlet 50 (FIG. 4) in housing cover 24 from the furnace into the blower housing 20, and the exhaust gases are discharged through outlet 36 of exhaust transition 34. Although the foregoing blower housing has proven to be effective for use with high efficiency furnaces, improvements to same are desired.

First, during the molding of housing body 22, tubular exhaust transition 34 is formed by a cylindrical-shaped exhaust transition mold (not shown). After the plastic material of housing body 22 cures, the exhaust transition mold is pulled outwardly from housing body 22 in a tangential or radial direction with respect to housing body 22. At least one other larger inner mold (not shown), which is cylindrically-shaped, is used to form the interior of housing body 22 and, after the plastic material of housing body 22 cures, is pulled away from housing body 22 along the axial direction with respect to housing body 22. Notably, it is not practical to shape the inner end of the exhaust transition mold to fit perfectly tangentially along the cylindrical outer surface of the housing body interior mold. Therefore, the exhaust transition mold is shaped to project radially outwardly from the cylindrical outer surface of the housing body interior mold a short distance. Thus, when housing body 22 is molded, the exhaust transition mold forms a recessed area 52 in exhaust transition 34, best shown in FIG. 3, which is radially offset from outer wall 26 of housing body 22. Problematically, this recessed area 52 defines an abrupt outward step or "bump" in the air flow through exhaust transition 34 which, as shown by the air flow arrows in FIG. 3, causes undesired turbulence and swirl in the air flow in recessed area 52 as the air flow passes through exhaust transition 34 toward outlet 36 of housing body 22.

Additionally, as may be seen from FIGS. 2 and 3, the intersection of the cylindrical exhaust transition mold and the cylindrical housing body interior mold which are used to form housing body 22 forms a sharp exhaust cutoff 54 within housing body 22, which is present in blower housing 20 and in many other known blower housings. Cutoff 54 is located proximate exhaust transition 34, and defines the point within blower housing 20 which separates the air flow through exhaust transition 34 from the remainder of the air flow within blower housing 20. As may be seen in FIGS. 2 and 3, the outer edge of impeller 46 is disposed very close to cutoff 54 to maximize the efficiency of air flow in blower housing 20 and to prevent back flow of air through the gap between impeller 46 and cutoff 54 into exhaust transition 34. As represented by the air flow arrows in FIG. 3, as impeller 44 rotates, a blade pass noise is generated as pressure waves exhausting the blade passages of impeller 46 impinge upon cutoff 54.

Known blower housings have included features for masking the foregoing blade pass noise. For example, a blower housing disclosed in U.S. Pat. No. 5,316,439 includes either a noise cancellation rod located within the outlet of the blower housing, or a nose-like projection projecting inwardly from the exhaust transition. Noise generated from one of the foregoing components interferes with, and substantially cancels out, the blade pass noise generated by the impeller blades passing the sharp cutoff. U.S. Pat. No. 5,484,259 to Ahmed et al. discloses a blower housing having a fin near the cutoff to provide a vortex in the air flow near the cutoff to reduce noise. However, these and similar methods only mask the blade pass noise, rather than eliminating such noise.

What is needed is a draft inducer blower housing for high efficiency furnaces which is an improvement over the foregoing.

SUMMARY OF THE INVENTION

The present invention provides a draft inducer blower for high efficiency furnaces, including a blower housing which facilitates maximum air flow efficiency through the blower housing while reducing air flow noises. The blower housing generally includes a housing body and housing cover which define an exhaust transition therebetween, which transitions the air flow from the circular main cavity of the blower housing to the blower housing outlet. The housing body and housing cover are attached to one another via a lobed joint along the exhaust transition, and each include complementary, smoothly contoured inner surfaces to facilitate smooth air flow through the exhaust transition toward the outlet. Additionally, the housing body and housing cover include cooperating cutoff surfaces which form a broadly radiused cutoff within the blower housing to reduce or eliminate the blade pass noise associated with contact of the air flow from the impeller with the cutoff.

In particular, the housing body and housing cover are attached to one another along a primary joint line which extends around the outer peripheries thereof, and are also attached to one another along a secondary, lobed joint line which extends along the exhaust transition and slopes upwardly in the axial direction toward the exhaust outlet. The foregoing construction allows the inner surfaces of the housing body and housing cover to be molded as smoothly contoured and complementary surfaces in the area of the exhaust transition to facilitate smooth air flow through the exhaust transition toward the outlet. In this manner, the air flow does not encounter obstructions in the exhaust transition which would induce turbulence in the air flow, generating noise and compromising the air flow efficiency of the blower housing.

The housing body and housing cover each include broadly radiused cutoff portions which, when the housing cover is joined to the housing body, cooperate with one another via a pin-and-hole joint to define a broadly radiused cutoff to reduce or eliminate blade pass noise associated with the cutoff. Additionally, the pin-and-hole joint between the cutoff portions of the housing body and housing cover aids in locating the housing body with respect to the housing cover, and also forces the mutually facing surfaces of the housing body and housing cover into tight engagement with one another to assure minimum edge mismatches due to part warpage, for example, such that no protruding edges cause turbulence in the air flow.

Advantageously, the internal and external features of the housing body are configured such that the housing body may be formed according to a molding process using a pair of molds which may be separated from the housing body along the Z-axis direction after the plastic material of the housing body cures. Only one additional mold is needed to form the circular outlet of the housing body, which mold may conveniently take the form of a short, cylindrical mold which is separated from the housing body in the radial or X- or Y-axis direction after the plastic material of the housing body cures. In a similar manner, the features of the housing cover are configured to allow the housing cover to be formed via a molding process including a pair of molds which may be separated from the housing cover in the axial direction after the plastic material of the housing cover cures. In this manner, manufacture of the blower housing from plastic material, via a molding process such as injection molding, is simplified.

In one form thereof, the present invention provides a blower housing defining perpendicular axial and radial directions, including a first housing member including a substantially cylindrical outer wall, and a circular outlet projecting in the radial direction from the outer wall; a second housing member including a substantially circular base wall; an exhaust transition defined by at least one of the first and second housing members; and a broadly radiused cutoff disposed within the blower housing adjacent the exhaust transition, the cutoff defined by at least one of the first and second housing members.

In another form thereof, the present invention provides a blower housing defining perpendicular axial and radial directions, including a first housing member including a substantially cylindrical outer wall and a circular outlet projecting in the radial direction from the outer wall; a second housing member including a substantially circular base wall; an exhaust transition extending toward the outlet, the exhaust transition defined by the first and second housing members; and a first joint line between the first and second housing members, the first joint line extending along the exhaust transition and sloping in the axial direction toward the outlet.

In further form thereof, the present invention provides a blower housing defining perpendicular axial and radial directions, including first and second housing members connected to one another to define a circular main cavity therebetween; a plurality of mounting lugs disposed in spaced relation around an outer periphery of the blower housing; a circular outlet projecting in the radial direction from the blower housing, the outlet formed by at least one of the first and second housing members; an exhaust transition extending from the main cavity toward the outlet, the exhaust transition defined by the first and second housing members; and each of the first and second housing members including smoothly contoured interior surfaces extending along the exhaust transition from the main cavity toward the outlet.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 5:
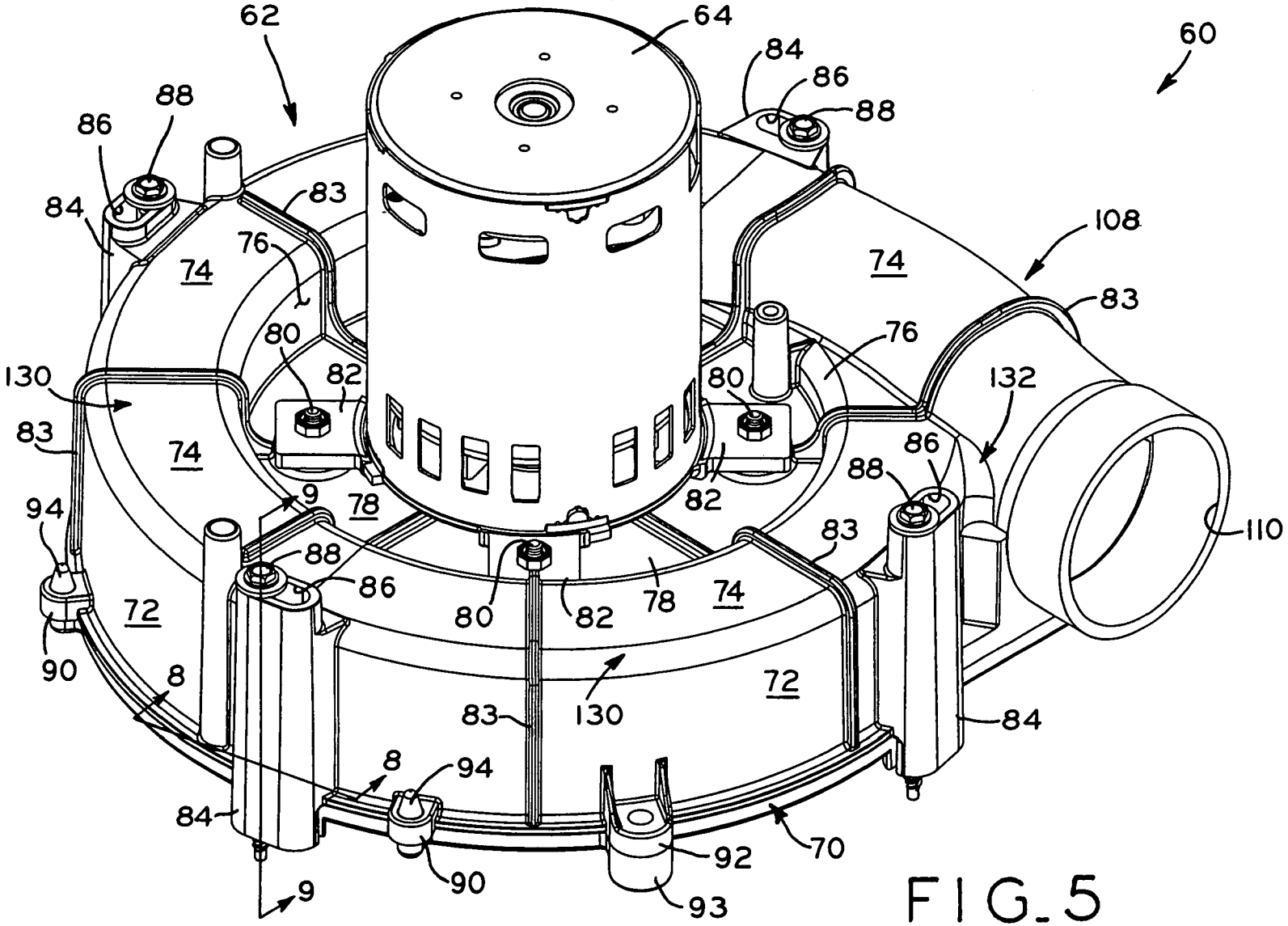
FIG. 5 is a perspective view of a blower for high efficiency furnaces, including a blower housing according to the present invention.
Figure 6:
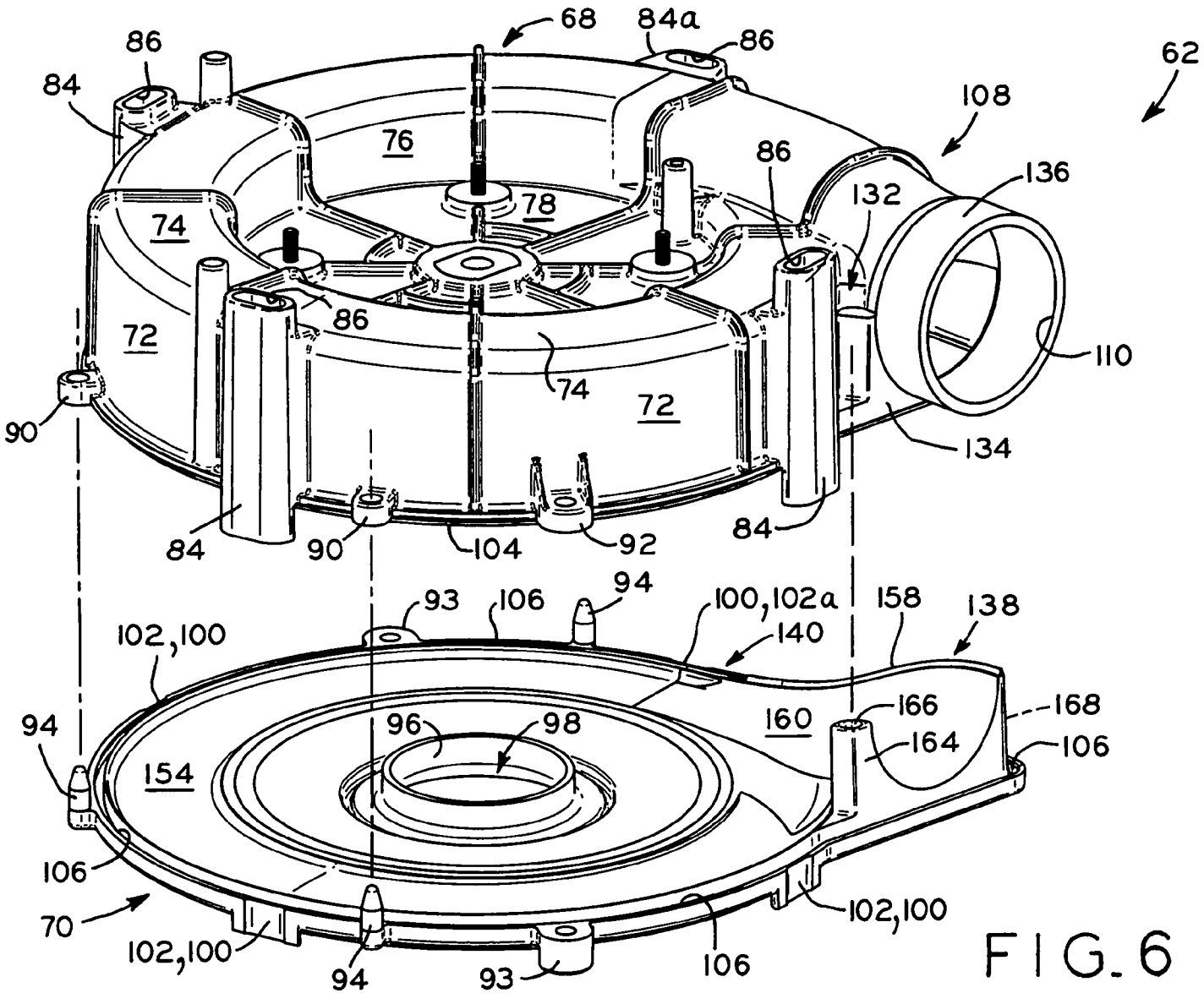
FIG. 6 is a first exploded view of the housing body and housing cover of the blower housing, looking downwardly.
Figure 7:
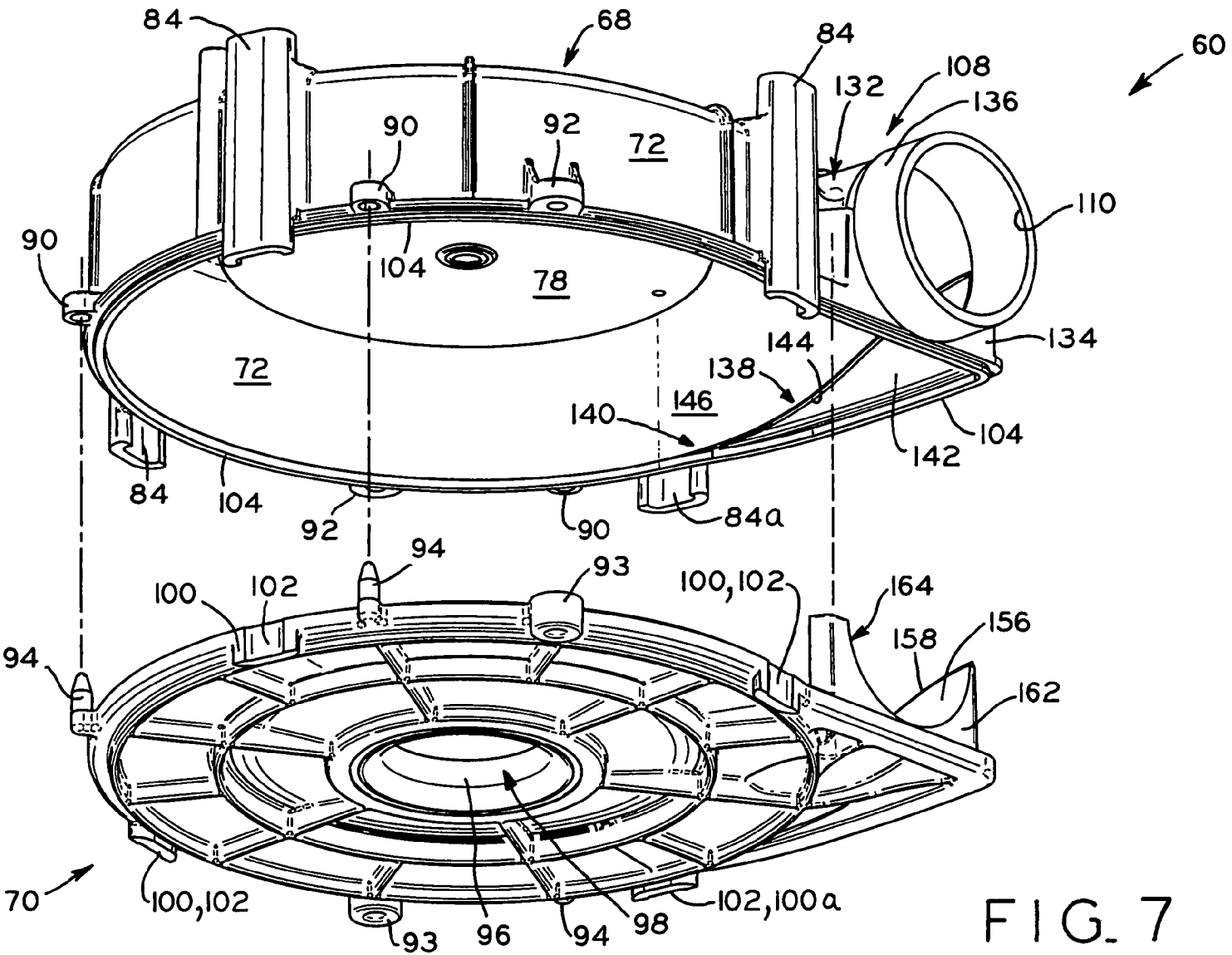
FIG. 7 is a second exploded view of the housing body and housing cover of the blower housing, looking upwardly.

Referring first to FIGS. 5–7, a blower 60 for a high efficiency furnace according to the present invention is shown. Blower 60 generally includes blower housing 62, electric motor 64 mounted to blower housing 62, and an impeller (FIGS. 7 and 8), described below, mounted to the output shaft 66 of motor 64 and disposed within blower housing 62. Blower housing 62 generally includes a first housing member or housing body 68, and a second housing member or housing cover 70. Housing body 68 and housing cover 70 may be formed of metal or plastic according to an injection molding process, for example. Suitable plastics for housing body 68 and housing cover 70 include polypropylene or other thermoplastics. Housing body 68 includes a generally cylindrical outer wall 72, an annular top wall 74, an inner wall 76, and a circular, recessed wall 78. Motor 64 is attached to recessed wall 78 by a plurality of fasteners 80 which pass through mounting flanges 82 of motor 64 and into holes in recessed wall 78 of housing body 68. Housing body 68 additionally includes a plurality of reinforcement ridges 83 extending along outer wall 72, top wall 74, inner wall 76, and recessed wall 78 for providing structural strength and rigidity to housing cover 70. Generally, blower housing 62 defines an axial or Z-axis direction which is aligned along the axis of output shaft 66 of motor 64, as well as radial or X- and Y-axis directions which are aligned perpendicular to the axial or Z-axis direction.

Figure 9:
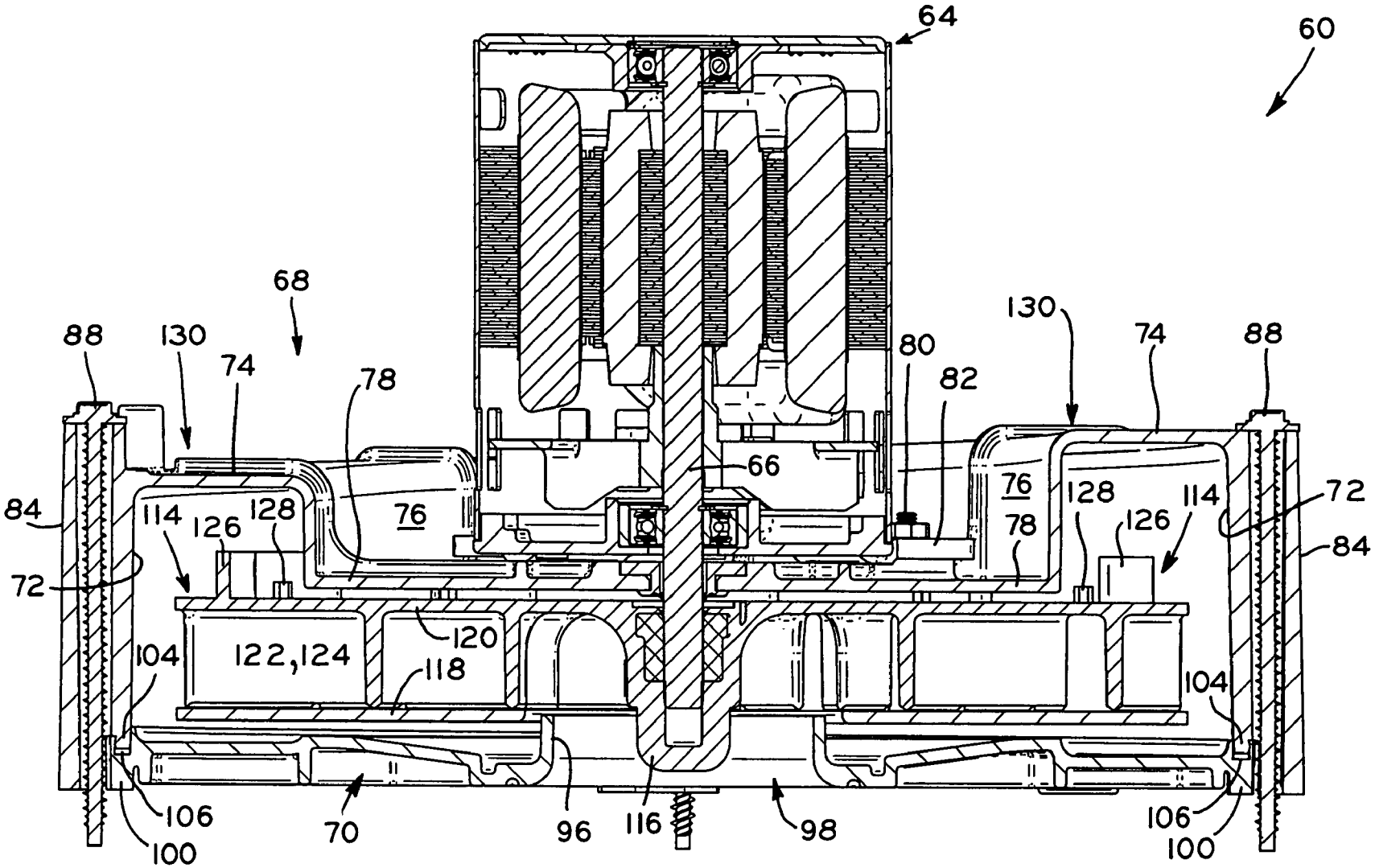
FIG. 9 is a vertical sectional view through the blower of FIG. 5, taken along line 9—9 of FIG. 5.

Housing body 68 additionally includes a plurality of mounting lugs 84 integrally formed therewith, which are disposed radially outwardly of sidewall 72 in spaced relationship around the outer periphery of blower housing 62. Alternatively, at least a portion of mounting lugs 84 may be formed with housing cover 70. Mounting lugs 84 include slot-like or oval openings 86 for receipt of bolts 88 to attach blower housing 62 to wall 38 (FIG. 4) of a furnace. As shown in FIG. 9, bolts 88 extend downwardly through mounting lugs 84 of housing body 68, adjacent recesses 102 in lug feet 100 of housing cover 70 (discussed below), and into holes 44 (FIG. 4) in furnace wall 38 to rigidly secure blower housing 62 to wall 38 of the furnace, with housing cover 70 captured between housing body 68 and furnace wall 38. Additionally, housing body 68 includes a plurality of locating lugs 90 integrally formed therewith, which are disposed radially outwardly of outer wall 72 and spaced around the outer periphery of housing cover 70. Locating lugs 90 include openings for receipt of upwardly-projecting locating pins 94 of housing cover 70 to thereby positively locate housing cover 70 with respect to housing body 68 during assembly of blower housing 62. Optionally, housing body 68 includes one or more attachment lugs 92 for receipt of fasteners (not shown) which pass therethrough and also through one or more corresponding optional attachment lugs 93 of housing cover 70 to secure blower housing 62 to furnaces having an alternate furnace mounting bolt pattern. Further details of housing body 68 are discussed below.

Figure 1:
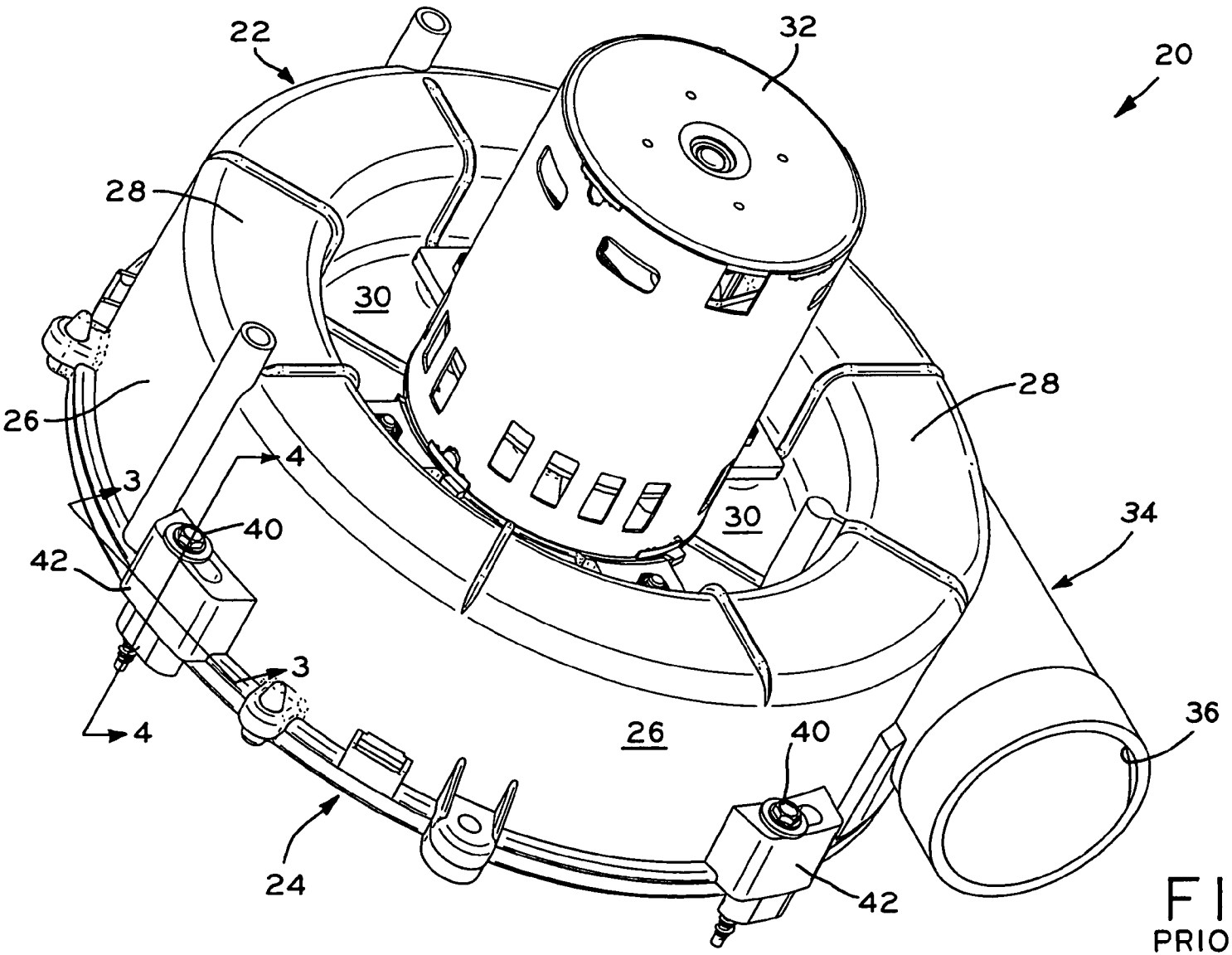
FIG. 1 PRIOR ART
FIG. 1 is a perspective view of a known blower and blower housing for high efficiency furnaces.
Figure 2:
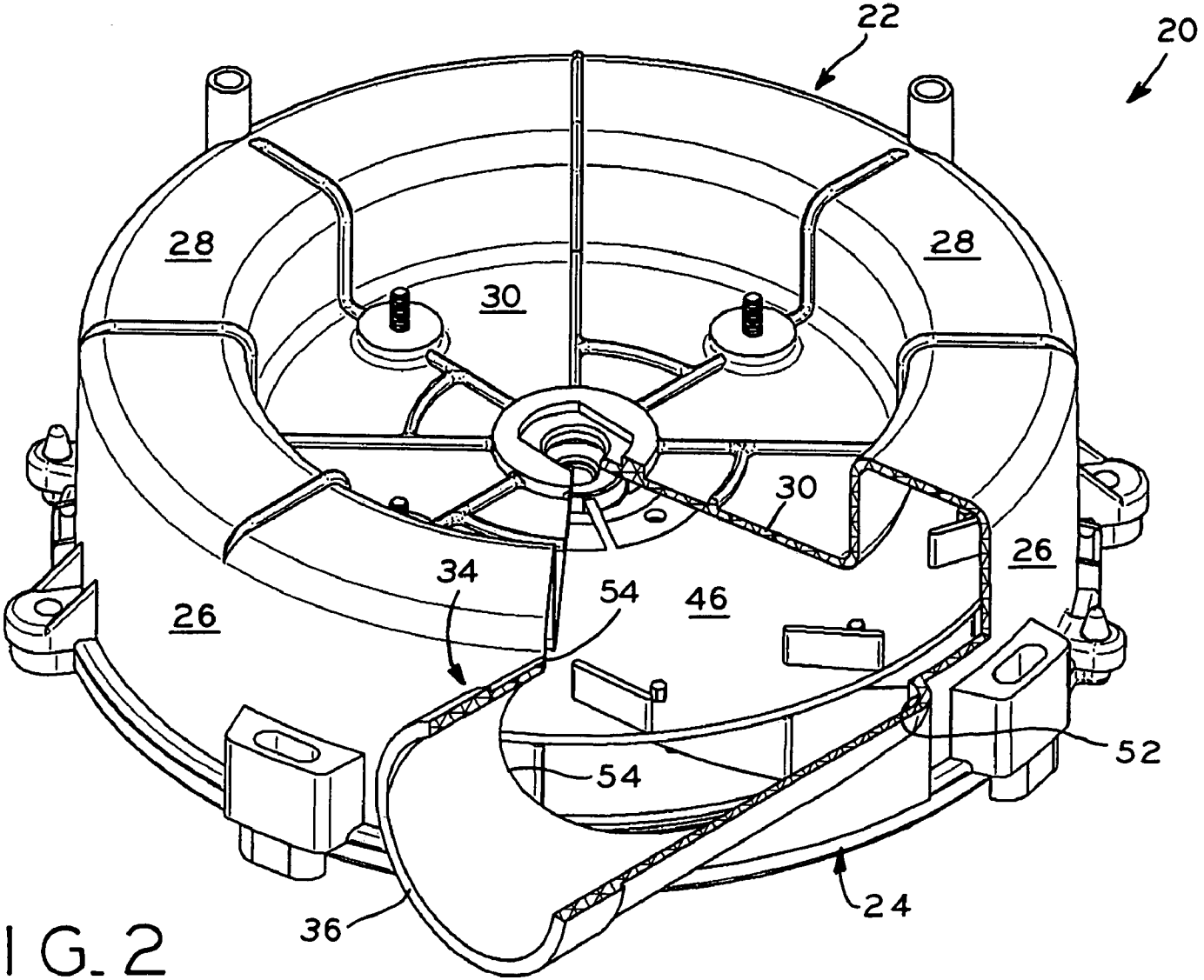
FIG. 2 PRIOR ART
FIG. 2 is another perspective view of the blower housing of the blower of FIG. 1, with a portion of the housing body and housing cover cut away to show the interior of the blower housing in the exhaust transition and cutoff thereof.
Figure 3:
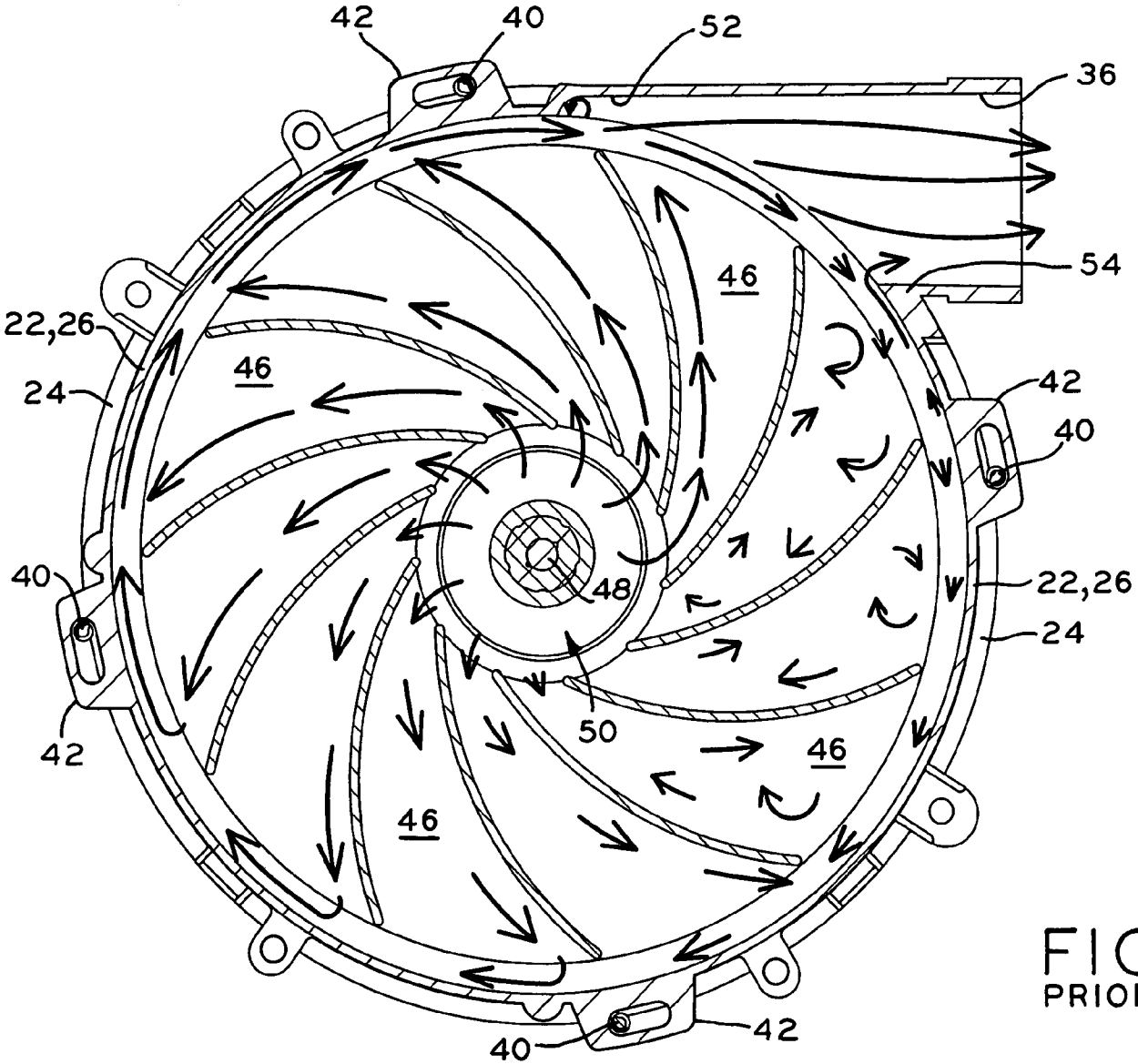
FIG. 3 PRIOR ART
FIG. 3 is a horizontal sectional view through the blower of FIG. 1, taken along line 3—3 of FIG. 1 and looking downwardly, with the air flow through the blower housing shown by arrows.
Figure 4:
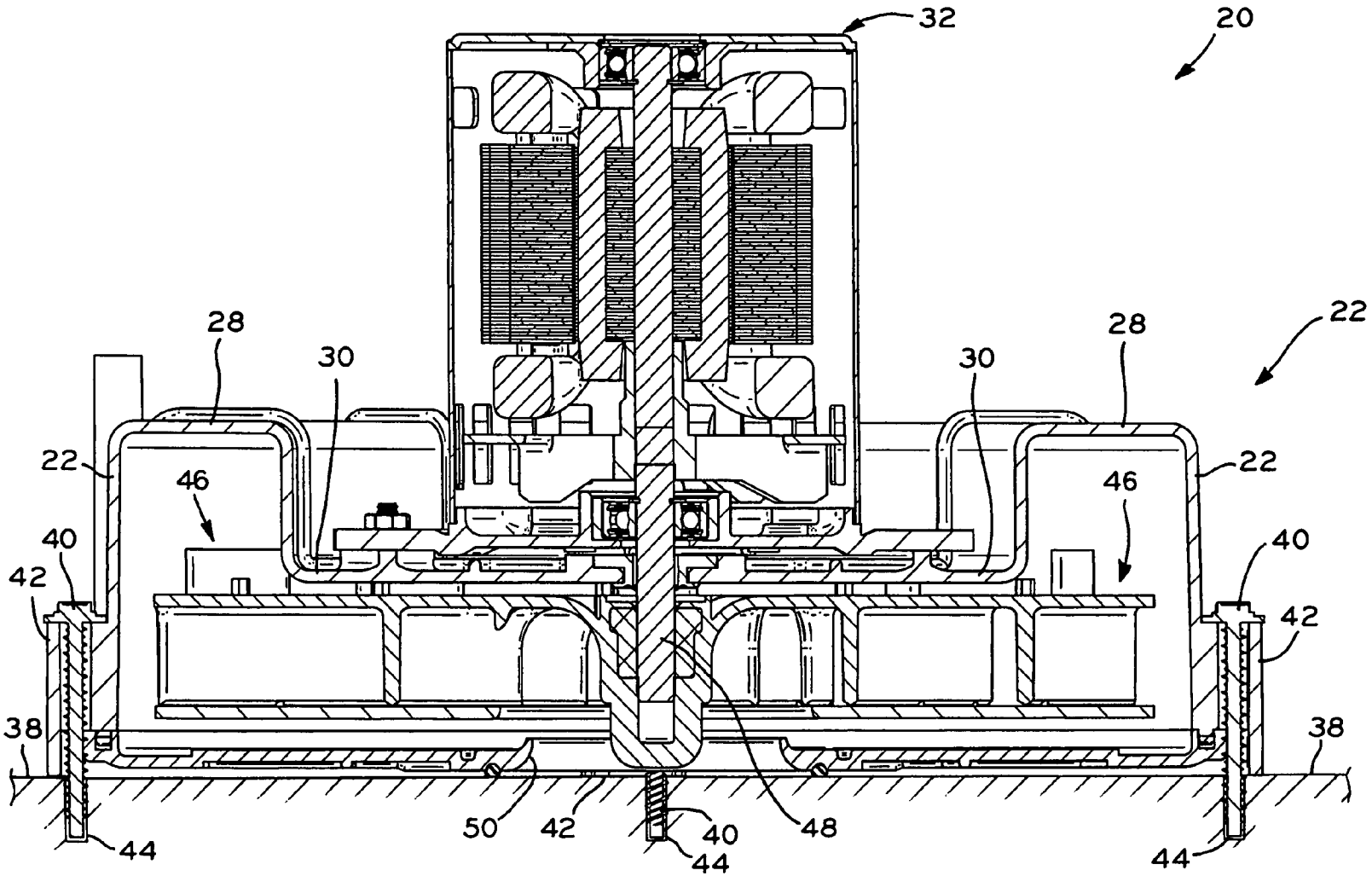
FIG. 4 PRIOR ART
FIG. 4 is a vertical sectional view through the blower of FIG. 1, taken along line 4—4 of FIG. 1.

Housing cover 70 cooperates with housing body 68 to define an enclosed, circular main cavity therebetween. Housing cover 70 includes a centrally disposed, inwardly-projecting, circular lip 96 defining a circular inlet opening 98. Housing cover 70 also includes a plurality of lug feet 100 having recesses 102 which align with the openings 86 of mounting lugs 84. As may be seen from FIG. 9, lug feet 100 of housing cover 70 and mounting lugs 84 of housing body 68 cooperate to support blower housing 62 on the wall of a furnace with a slight air gap between housing cover 70 and furnace wall 38 (FIG.4). A gasket may be provided between housing cover 70 and the furnace wall to provide an air seal therebetween. Further details of housing cover 70 are described below.

Referring to FIGS. 6, 7, and 9–11, housing body 68 includes a downwardly-projecting tongue 104 disposed about the periphery thereof, which is received within a corresponding groove 106 about the periphery of housing cover 70, shown in FIGS. 6, 9, 11, and 12, in a snap-fit manner to thereby secure housing cover 70 to housing body 68 along a primary joint line which extends around outer wall 72 from the cutoff region of blower housing 62 to the exhaust transition of blower housing 62, discussed below, and thence around the lobed joint of blower housing 62 back to the cutoff region. Further details regarding the snap-fit attachment of housing cover 70 to housing body 68 provided by tongue 104 and groove 106 are described in detail in U.S. Pat. No. 5,954,476 to Stewart et al., assigned to the assignee of the present invention, the disclosure of which is expressly incorporated therein by reference. Alternatively, housing body 68 may include groove 106, and housing cover 70 may include tongue 104. Optionally, a gasket or other seal (not shown) formed of a suitable resilient material, such as rubber or EPDM foam cording, for example, may be fitted between tongue 104 and groove 106 to enhance the seal therebetween. As may be seen from FIG. 9, when blower housing 62 is attached to the wall of a furnace, lug feet 100 of housing cover 70 contact the wall of the furnace to maintain axial pressure on the snap-fit primary joint line between tongue 104 of housing body 68 and groove 106 of housing cover 70.

As shown in FIGS. 5–8 and 10–13, housing body 68 and housing cover 70 cooperate to define an exhaust transition 108 which extends tangentially from the last mounting lug 84 of housing body and the last lug foot 100 of housing cover 70 in the air flow path to circular exhaust outlet 110 of housing body 68. The last mounting lug 84 of housing body 68 and lug foot 100 of housing cover 70 in the air flow path will hereinafter be designated with reference numerals 84*a* and 100*a*, respectively. An exhaust pipe or other duct structure (not shown) may be attached to exhaust outlet 110 in a suitable manner, such as with clamps or other fasteners. Further details of exhaust transition 108 are described below.

Figure 8:
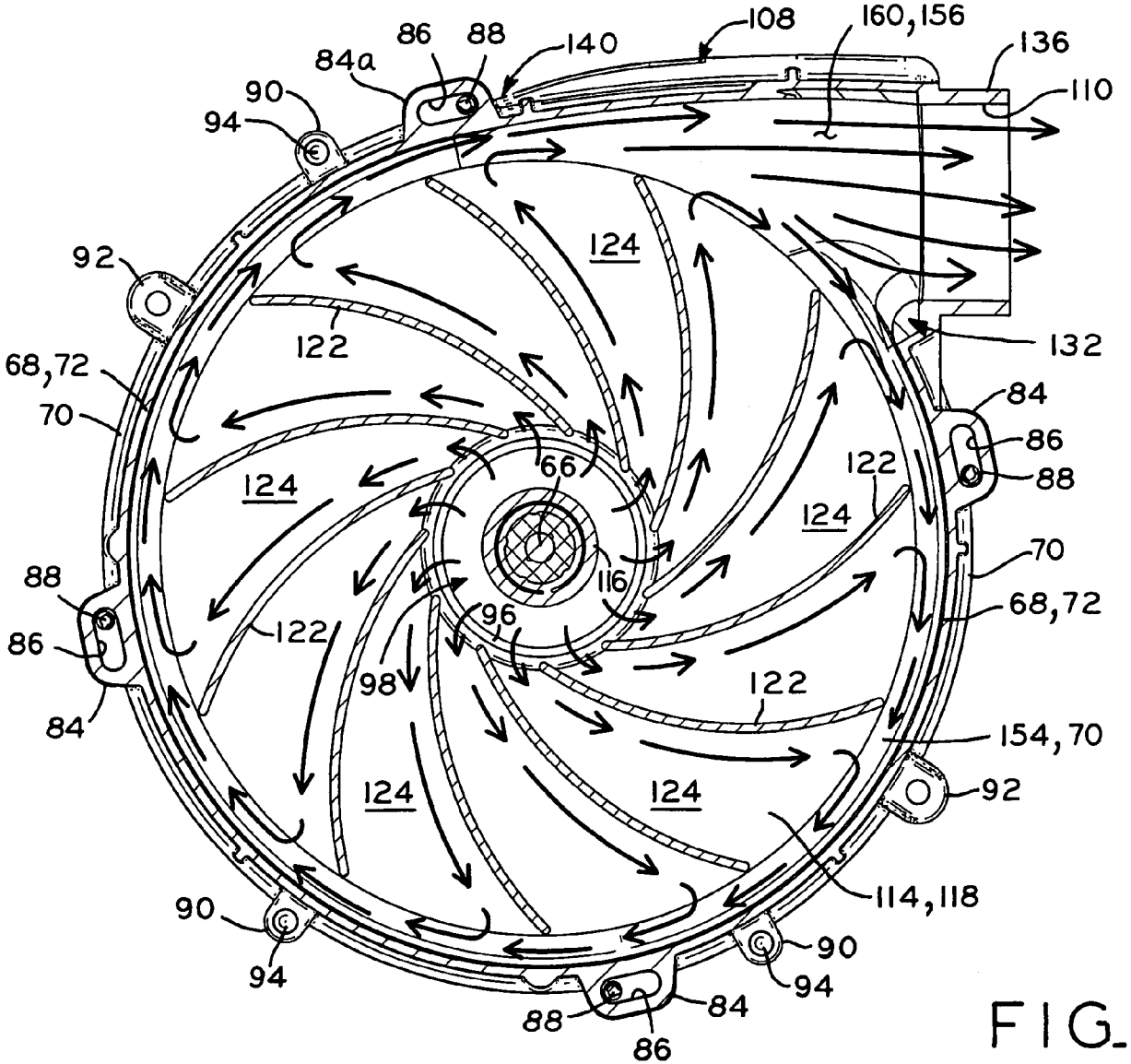
FIG. 8 is a horizontal sectional view through the blower of FIG. 5, taken along line 8—8 of FIG. 5 and looking downwardly.

Referring to FIGS. 8 and 9, impeller 114 includes central hub 116, which is secured to output shaft 66 of motor 64 in a suitable manner for rotation within blower housing 62, and also includes lower plate 118 and upper plate 120 having a plurality of backward-curved blades 122 extending from central hub 116 between lower plate 118 and upper plate 120. A plurality of blade passages 124 are defined between each pair of blades 122 radially around impeller 114. Impeller 114 also includes a plurality of auxiliary blades 126 projecting upwardly from upper plate 120, and a plurality of balancing lugs 128 projecting from upper plate 120 and spaced radially about upper plate 120. Impeller 114 may be made of a lightweight metal, or from a lightweight yet durable plastic material, for example.

Housing body 68 of blower housing 62 defines radial X- and Y- axis dimensions which correspond to the diameter of sidewall 72 of housing body 68, as well as an axial or Z-axis dimension which is co-axial with the rotation axis of impeller 114 and drive shaft 66 of motor 64, and which corresponds to the height of outer wall 72 of housing cover 70. Outer wall 72, top wall 74, and inner wall 76 of housing body 68 cooperate to define a volute 130 of housing body 68 which extends around the circumference and outer periphery of blower housing 62 and increases in cross-sectional area from cutoff 132 of blower housing 62 to exhaust transition 108 of housing body 68, as described in further detail in co-pending U.S. patent application Ser. No. 10/934,004, entitled DRAFT INDUCER BLOWER WITH Z-AXIS VOLUTE, filed on Sep. 3, 2004, assigned to the assignee of the present invention, the disclosure of which is expressly incorporated herein by reference. Volute 130 is curved around the outer periphery of blower housing 62 through an angle of at least 180° and, as shown in FIG. 5, volute 130 curves around the outer periphery of blower housing 62 from cutoff 132 to transition section through an angle slightly greater than 270°.

According to the present invention, blower housing 62 includes a lobed joint between housing body 68 and housing cover 70 at exhaust transition 108, in addition to the planar, circular primary joint provided between tongue 104 of housing body 68 and groove 106 of housing cover 70. As shown by the air flow arrows in FIG. 8 and discussed in further detail below, the lobed joint provided between housing body 68 and housing cover 70 facilitates smooth, uninterrupted air flow through exhaust transition 108 from the circular main cavity of blower housing 62 toward outlet 110 of blower housing 62, and provides a broadly radiused cutoff 132 for reducing or eliminating blade pass noise in blower housing 62, while allowing housing body 68 and housing cover 70 to be molded primarily with molds that conveniently separate from housing body 68 and housing cover 70 in the Z-axis direction.

Referring to FIGS. 6, 7, 10, and 11, housing body 68 additionally includes wall 134 aligned in the axial or Z-axis direction, which is connected to outer wall 72 at cutoff 132, and is also connected to exhaust transition 108. Cylindrical outlet wall 136 projects outwardly from wall 134 in the radial direction to define outlet 110 of blower housing 62. A lobed joint line 138, which may be considered a secondary joint line with respect to the primary joint line between housing body 68 and housing cover 70 described above, extends between housing body 68 and housing cover 70 along exhaust transition 108. A transition point 140 is defined between housing body 68 and housing cover 70 immediately downstream of mounting lug 84*a* of housing body and lug foot 100*a* of housing cover 70, where lobed joint line 138 begins to extend from the primary joint line. Lobed joint line 138 slopes upwardly in the axial or Z-axis direction from joint transition point 40 toward wall 134 of housing body 68. As may be seen in FIGS. 7, 10, and 11, tongue 104 of housing body 68, which cooperates with groove 106 of housing cover 70 to form the primary joint line, extends around housing body 68 beneath exhaust transition 108 and wall 134.

A recess 142 is defined in exhaust transition 108 of housing body 68 beneath lobed joint line 138, and a groove 144 is formed in housing body 68 along lobed joint line 138 above recess 142. As may be seen in FIGS. 6, 10, and 11, from transition point 140 immediately downstream of mounting lug 84*a* and lug 100*a*, outer wall 72, top wall 74, and inner wall 76 of housing body 68 merge with one another to define a smoothly contoured, curved inner surface 146 of housing body 68 along exhaust transition 108.

A recess 148 is defined within housing body 68 proximate wall 134 and outlet wall 136 at the beginning of outer wall 72 beneath a first cutoff portion or cutoff hub 150. Cutoff hub 150 is broadly radiused, wherein cutoff hub 150 does not include sharp edges. A pin 152 projects downwardly from cutoff hub 150 into recess 148 in the axial or Z-axis direction.

Referring to FIGS. 6, 7, 12, and 13, housing cover 70 generally includes a circular base wall 154 having groove 106 defined around the outer periphery thereof which, as described above, receives tongue 104 of housing body 68 to define the primary joint line between housing body 68 and housing cover 70. Lip 96 extends upwardly from base wall 154 to define inlet opening 98 in housing cover 70. Housing cover 70 additionally includes other features, such as an annular depression in base wall 154 which cooperates with housing body 68 to form volute 130, as well as an annular ridge and a conically-shaped, sloped wall between the annular ridge and lip 96. The foregoing features, and the advantages provided by same, are described in further detail in the above-incorporated co-pending U.S. patent application Ser. No. 10/934,004.

Housing cover 70 additionally includes a lobe 156 having an upper edge which slopes upwardly in the axial or Z-axis direction along lobed joint line 138 from transition point 140 to wall 134 of housing body 68. The upper edge of lobe 156 includes a tongue 158 shaped to fit within groove 144 of housing body 68 to form lobed joint line 138 between housing body 68 and housing cover 70. Optionally, a gasket or other seal (not shown) formed of a suitable resilient material, such as rubber or EPDM foam cording, for example, may be fitted between groove 144 and tongue 158 to enhance the seal therebetween. As may be seen from FIGS. 9, 10, 13, and 14, groove 106 of housing cover 70, which cooperates with tongue 104 of housing body 68 to form the primary joint therebetween, extends around lobe 156 beneath exhaust transition 108 and wall 134 of housing body 68. Lobe 156 includes a smoothly, curved, contoured inner surface 160 extending from transition point 140 to an outer wall 162 of lobe 156 which is fitted against wall 134 of housing body 68 when housing cover 70 is joined to housing body 68.

Housing cover 70 additionally includes a broadly-radiused second cutoff portion or cutoff projection 164 projecting from base wall 154 of housing cover 70 in the axial or Z-axis direction, which includes a hole 166 in the upper end thereof which is aligned in the axial or Z-axis direction. Also, the cutoff surface of cutoff projection 164 is sloped upwardly in the axial or Z-axis direction from base wall 154 to the upper end of cutoff projection 164. When housing cover 70 is joined to housing body 68, pin 152 of cutoff hub 150 of housing body 68 is fitted within hole 166 of cutoff projection 164 of housing cover 70 to locate housing cover 70 with respect to housing body 68 and to tightly engage the mating surfaces of housing cover 70 and housing body 68. Alternatively, cutoff hub 150 may include hole 166 and cutoff projection 164 may include pin 152, or cooperating structure other than a pin-and-hole fitting may be provided between cutoff hub 150 and cutoff projection 164. Also, when housing cover 70 is joined to housing body 68, the radially outer wall 168 of lobe 156 is received within recess 142 of housing body 68.

Advantageously, as shown in FIGS. 6–8, the broadly-radiused surfaces of cutoff projection 164 of housing cover 70 and cutoff hub 150 of housing body 68 cooperate to define a broadly radiused cutoff 132 within blower housing 62, which is spaced from the outer edge of impeller 114.

Figure 12:
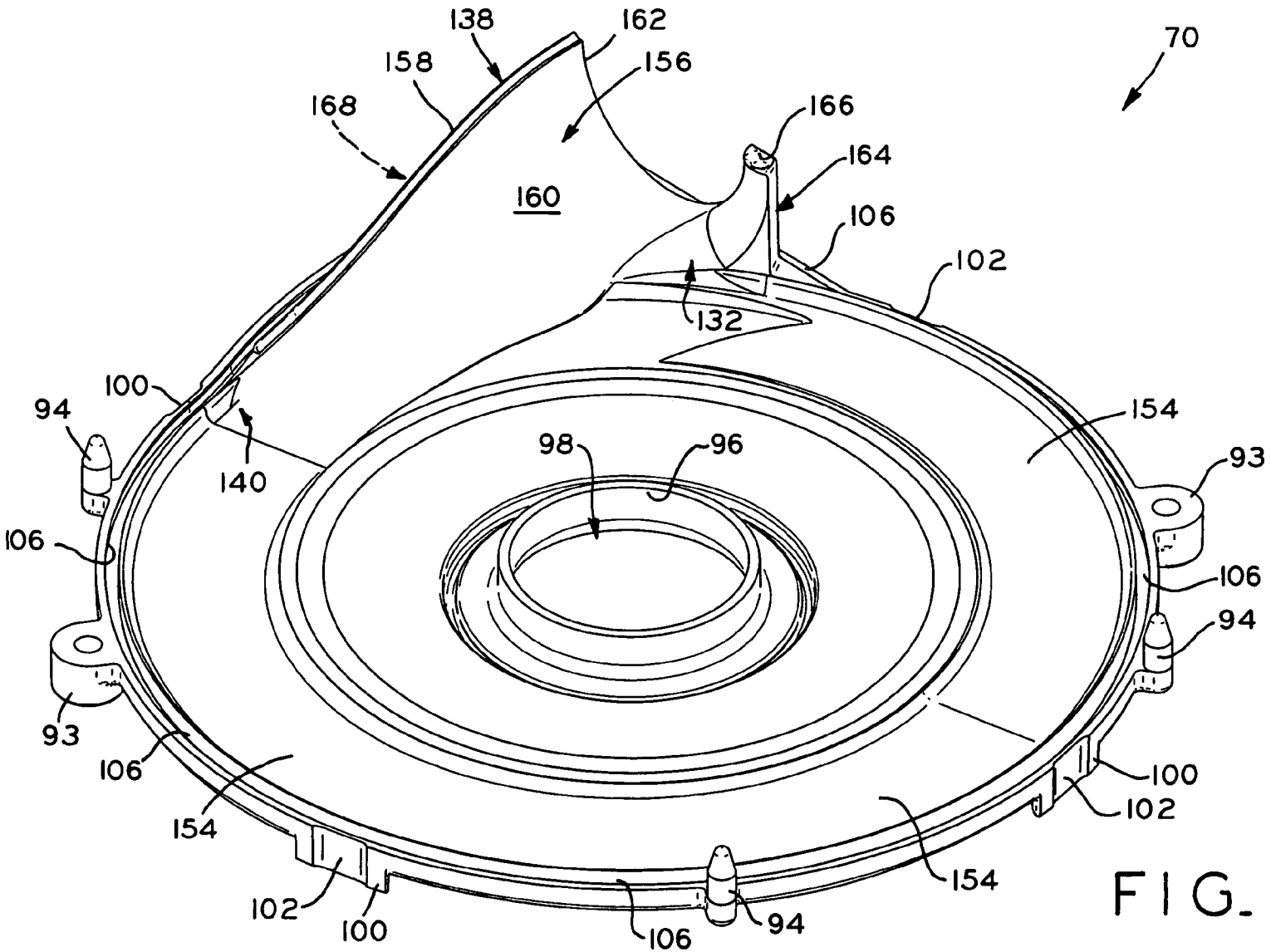
FIG. 12 is a first perspective view of the housing cover, looking downwardly.
Figure 13:
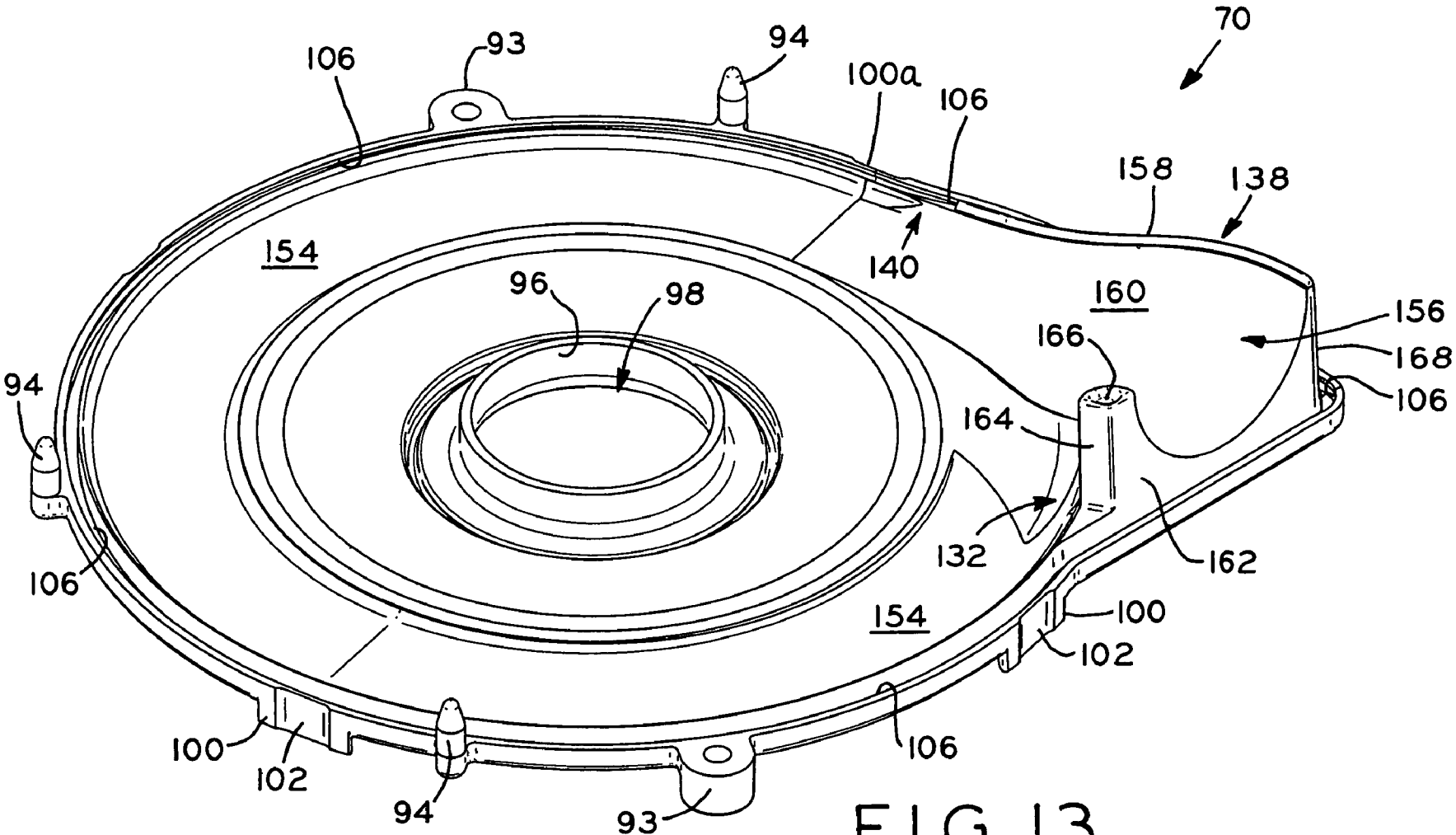
FIG. 13 is a second perspective view of the housing cover, looking downwardly.

Also, the cutoff surface of cutoff projection 164 is advantageously sloped upwardly in the axial or Z-axis direction from base wall 154 to the upper end of cutoff projection 164, as best shown in FIG. 12. In this manner, as impeller 114 rotates within blower housing, air flow through blade passages 124 of impeller 114 smoothly contacts the broadly radiused and upward-sloped surface of cutoff 132 such that the air flow is only gradually "sliced" or separated from exhaust transition 108 at cutoff 132, and does not create significant blade pass noise during operation of blower 60. This is in contrast with the cutoff 54 of known blower housing 20, shown in FIGS. 1–4 and described above, which includes a sharp cutoff edge which abruptly chops the air flow from the impeller to generate a loud blade pass noise.

Additionally, as shown in FIGS. 10–13, the smooth contours of inner surface 146 of exhaust transition 108 of housing body 68 and inner surface 160 of lobe 156 of housing cover 70 cooperate with one another to define a smoothly contoured region between the housing body 68 and housing cover 70 along exhaust transition 108 for minimal disruption of air flow therethrough from the circular main cavity of blower housing 62 to outlet 110 of blower housing 62 for maximum air flow efficiency.

Figure 10:
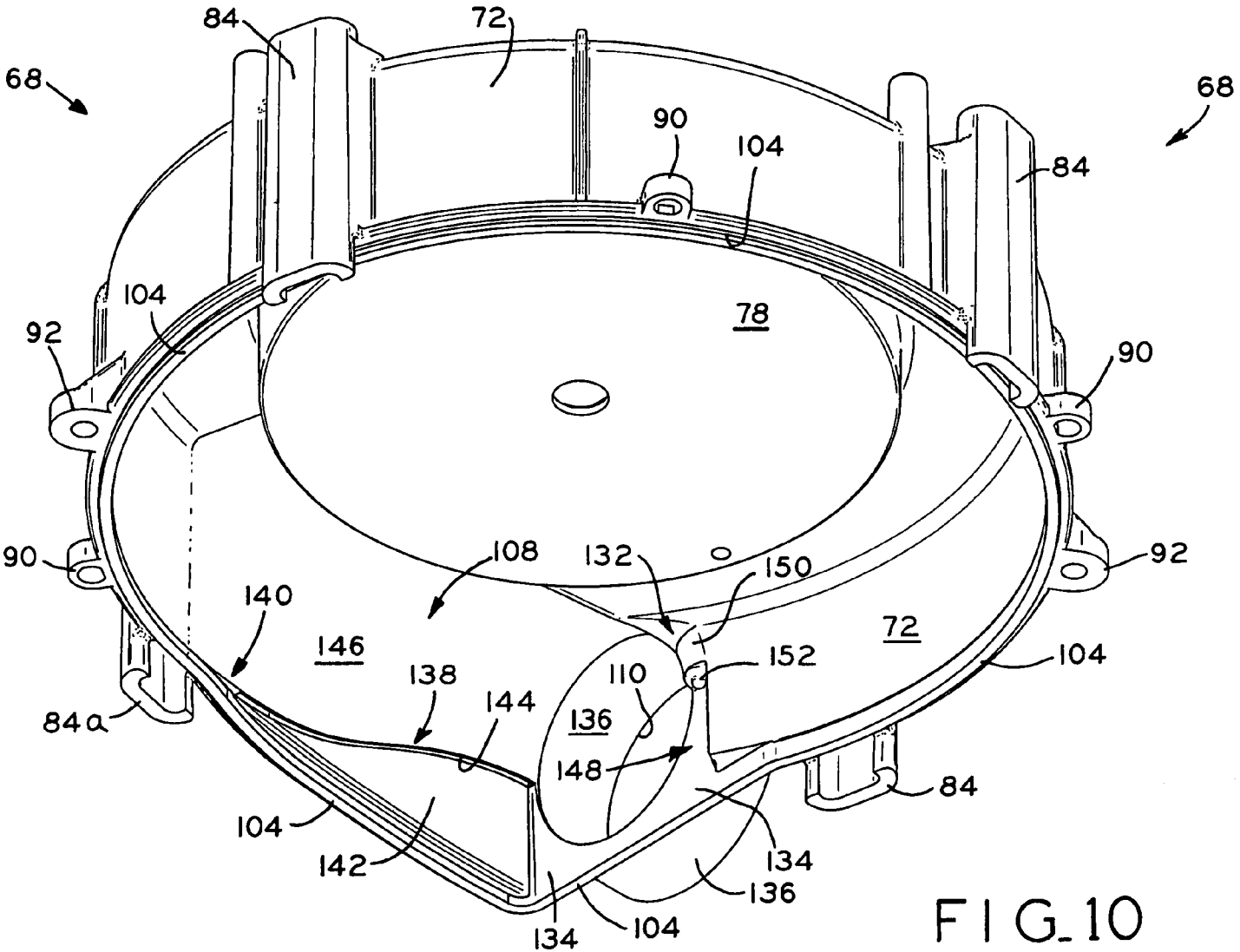
FIG. 10 is a first perspective view of the housing body, looking upwardly.
Figure 11:
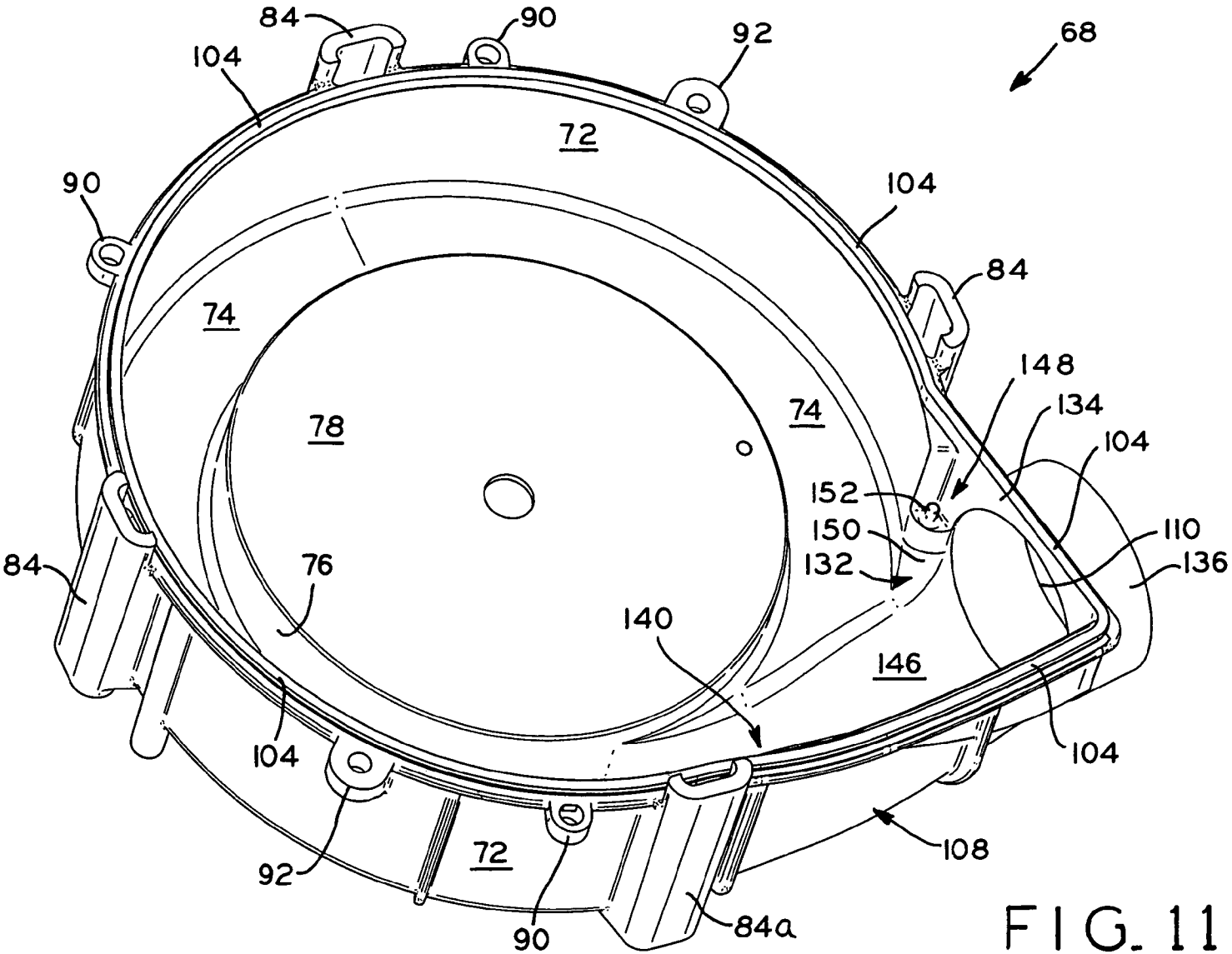
FIG. 11 is a second perspective view of the housing body, looking downwardly.

As may be seen from FIGS. 10 and 11, the overall shape of housing body 68 allows same to be easily formed via a molding process, such as injection molding, using a minimum number of molds. Specifically, the overall shape of housing body 68, including the features of mounting lugs 84, tongue 104, exhaust transition 108 with inner surface 146, recess 142, cutoff hub 150, and pin 152, allow housing body 68 to be molded using a pair of molds (not shown) which may be separated from housing body 68 in the axial or Z-axis direction after the plastic material of housing body 68 cures. Only a relatively small cylindrical mold (not shown) is needed to form outlet wall 136, which mold penetrates housing body 68 in the radial or X- or Y-axis direction only up to wall 134, and which is separated from housing body 68 in the radial or X- or Y-axis direction after the plastic material of housing body 68 cures. Similarly, as may be seen from FIGS. 12 and 13, the overall shape of housing cover 70, including the features of lip 96 and inlet opening 98, groove 106, lobe 156 with inner surface 160, cutoff projection 164 and hole 166, allow housing cover 70 to be molded using a pair of molds (not shown) which may be separated from housing cover 70 in the axial or Z-axis direction after the plastic material of housing cover 70 cures.

In a further embodiment, molded guide vanes and/or other air guiding devices (not shown) may be employed within exhaust transition 108 as a portion of one or both of housing body 68 and housing cover 70 to guide air flow between the circular main cavity of blower housing 62 and outlet 110 to efficiently direct air flow towards outlet 110 that might otherwise begin to spiral towards cutoff 132.

Finally, although blower housing 62 is shown in FIGS. 5–13 configured in a "clockwise" orientation, in which the shape of blower housing 62 is configured for clockwise rotation of impeller 114, blower housing 62 may alternatively be configured in a "counterclockwise" orientation, in which the shape of blower housing 62 is configured for counterclockwise rotation of impeller 114.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blower housing defining perpendicular axial and radial directions, comprising:

a first housing member including a substantially cylindrical outer wall, and a circular outlet formed in its entirely in said outer wall and projecting in the radial direction from said outer wall;

a second housing member including a substantially circular base wall and a lobe extending from said base wall into an interior of said blower housing and disposed adjacent said circular outlet, said lobe curved to conform to the shape of said circular outlet as said lobe approaches said circular outlet and sloping in the axial direction from said base wall toward said circular outlet, said curved lobe cooperating with said first housing member to define an exhaust transition adjacent said circular outlet;

a broadly radiused cutoff disposed within said blower housing adjacent said lobe and said exhaust transition, said cutoff defined by at least one of said first and second housing members.

2. The blower housing of claim 1, further comprising a plurality of mounting lugs disposed in spaced relation around an outer periphery of said blower housing.

3. The blower housing of claim 2, wherein said mounting lugs are integrally formed with one of said first and second housing members.

4. The blower housing of claim 1, wherein said cutoff includes a first cutoff portion formed with said first housing member.

5. The blower housing of claim 4, wherein said cutoff includes a second cutoff portion projecting in the axial direction from said base wall of said second housing member.

6. The blower housing of claim 5, wherein said first and second cutoff portions contact one another to define said cutoff.

7. The blower housing of claim 6, wherein said first cutoff portion includes one of a pin and a hole aligned in the axial direction, and said second cutoff portion includes the other of said pin and said hole aligned in the axial direction, said pin received within said hole to locate said first and second housing members with respect to one another.

8. The blower housing of claim 1, wherein said first and second housing members each include cooperating, smoothly contoured interior surfaces extending along said exhaust transition.

9. The blower housing of claim 1, wherein said first and second housing members are joined together along a primary joint line including tongue-and-groove attachment structure.

10. The blower housing of claim 9, further comprising a secondary joint line between said first and second housing members, said secondary joint line extending along said exhaust transition.

11. The blower housing of claim 10, wherein said secondary joint line slopes upwardly in the axial direction.

12. A blower housing defining perpendicular axial and radial directions, comprising:

a first housing member including a substantially cylindrical outer wall and a circular outlet formed in its entirety within said outer wall and projecting in the radial direction from said outer wall;

a second housing member including a substantially circular base wall;

a curved lobe extending from said second housing member into an interior of said blower housing, said lobe sloping in the axial direction as said lobe approaches said circular outlet and partially defining an exhaust transition extending toward said outlet, said exhaust transition further defined by said first and second housing members; and a first joint line between said first and second housing members, said first joint line extending along said exhaust transition and sloping in the axial direction toward said outlet.

13. The blower housing of claim 12, further comprising a plurality of mounting lugs disposed in spaced relation around an outer periphery of said blower housing.

14. The blower housing of claim 13, wherein said mounting lugs are integrally formed with one of said first and second housing members.

15. The blower housing of claim 12, wherein one of said first and second housing members includes a tongue extending along said first joint line, and the other of said first and second housing members includes a groove extending along said first joint line, said tongue fitting within said groove.

16. The blower housing of claim 12, wherein said first and second housing members are attached to one another along a second, substantially planar joint line.

17. The blower housing of claim 12, wherein said first and second housing members each include cooperating, smoothly contoured interior surfaces extending along said exhaust transition.

18. The blower housing of claim 12, further comprising a broadly radiused cutoff disposed within said blower housing adjacent said exhaust transition, said cutoff defined by at least one of said first and second housing members.

19. A blower housing defining perpendicular axial and radial directions, comprising:

first and second housing members connected to one another to define a circular main cavity therebetween;

a plurality of mounting lugs disposed in spaced relation around an outer periphery of said blower housing;

a circular outlet projecting in the radial direction from said blower housing, said outlet formed by at least one of said first and second housing members;

an exhaust transition extending from said main cavity toward said outlet, said exhaust transition defined by said first and second housing members; and a lobe extending from said second housing member into said main cavity, said lobe curved to conform to said circular outlet and sloping in the axial direction as said lobe approaches said outlet and including smoothly contoured interior surfaces extending along said exhaust transition from said main cavity toward said outlet.

20. The blower housing of claim 19, wherein said first and second housing members are attached to one another along a primary joint line which includes a tongue-and-groove attachment structure.

21. The blower housing of claim 20, further comprising a secondary joint line between said first and second housing members, said secondary joint line extending along said exhaust transition and sloping in the axial direction toward said outlet.

22. The blower housing of claim 19, further comprising a broadly radiused cutoff disposed within said blower housing adjacent said exhaust transition, said cutoff defined by at least one of said first and second housing members.

23. A blower housing defining perpendicular axial and radial directions, comprising:

first and second housing members connected to one another to define a substantially circular main cavity therebetween;

a plurality of mounting lugs disposed in spaced relation around an outer periphery of said blower housing;

a circular outlet projecting substantially in the radial direction from said blower housing, said outlet formed by at least one of said first and second housing members;

a lobe projecting from said second housing member into said circular main cavity adjacent said outlet, said lobe curved in said axial direction to conform to said circular outlet as said lobe extends toward said outlet, said lobe partially defining an exhaust transition extending from said main cavity toward said outlet and including smoothly contoured interior surfaces extending from said main cavity to said outlet.

24. The blower housing of claim 23, further comprising a plurality of mounting lugs disposed in spaced relation around an outer periphery of said blower housing.

25. The blower housing of claim 23, further comprising a broadly radiused cutoff disposed within said blower housing adjacent said exhaust transition, said cutoff defined by at least one of said first and second housing members.

* * * * *

UNITED STATES PATENT AND TRADEMARK OFFICE

CERTIFICATE OF CORRECTION

PATENT NO. : 7,210,903 B2
APPLICATION NO. : 10/934070
DATED : May 1, 2007
INVENTOR(S) : Leslie A. Lyons It is certified that error appears in the above-identified patent and that said Letters Patent is hereby corrected as shown below:

Claim 1, Column 10, Line 9, delete "entirely" and insert --entirety--

Signed and Sealed this

Eighteenth Day of September, 2007

JON W. DUDAS
*Director of the United States Patent and Trademark Office*